US010709940B2

(12) United States Patent
Kitagawa

(10) Patent No.: US 10,709,940 B2
(45) Date of Patent: Jul. 14, 2020

(54) GOLF CLUB WITH WEIGHT AND EXTERNAL RIB IN RECESS ON SOLE

(71) Applicant: BRIDGESTONE SPORTS CO., LTD., Tokyo (JP)

(72) Inventor: Tomonori Kitagawa, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 0 days.

(21) Appl. No.: 16/149,495

(22) Filed: Oct. 2, 2018

(65) Prior Publication Data

US 2019/0134471 A1 May 9, 2019

(30) Foreign Application Priority Data

Nov. 7, 2017 (JP) ..... 2017-215032

(51) Int. Cl.

| | |
|---|---|
| ***A63B 53/04*** | (2015.01) |
| ***A63B 53/08*** | (2015.01) |
| ***A63B 60/52*** | (2015.01) |
| ***A63B 60/02*** | (2015.01) |
| *A63B 102/32* | (2015.01) |
| *A63B 60/00* | (2015.01) |

(52) U.S. Cl.

CPC ..... *A63B 53/0466* (2013.01); *A63B 53/08* (2013.01); *A63B 60/02* (2015.10); *A63B 60/52* (2015.10); *A63B 2053/045* (2013.01); *A63B 2053/0408* (2013.01); *A63B 2053/0433* (2013.01); *A63B 2053/0491* (2013.01); *A63B 2060/002* (2015.10); *A63B 2102/32* (2015.10)

(58) Field of Classification Search

CPC ..... A63B 2053/045; A63B 53/0475; A63B 2053/0491

USPC ..... 473/349

See application file for complete search history.

(56) References Cited

U.S. PATENT DOCUMENTS

| | | | | | |
|---|---|---|---|---|---|
| 5,362,055 | A * | 11/1994 | Rennie | A63B 53/04 | 473/342 |
| 5,397,126 | A * | 3/1995 | Allen | A63B 53/04 | 473/324 |
| 5,547,194 | A * | 8/1996 | Aizawa | A63B 53/04 | 473/350 |
| 5,676,605 | A * | 10/1997 | Kobayashi | A63B 53/04 | 473/331 |
| 5,941,782 | A * | 8/1999 | Cook | A63B 53/04 | 473/346 |
| 6,306,048 | B1 * | 10/2001 | McCabe | A63B 53/04 | 473/333 |
| 6,368,234 | B1 * | 4/2002 | Galloway | A63B 60/00 | 473/349 |

(Continued)

FOREIGN PATENT DOCUMENTS

| | | |
|---|---|---|
| JP | 2016-106886 | 6/2016 |
| JP | 2016-214379 | 12/2016 |

*Primary Examiner* — William M Pierce

(74) *Attorney, Agent, or Firm* — IPUSA, PLLC

(57) ABSTRACT

A golf club head includes a face including a ball striking surface, a sole defining the bottom of the golf club head, and an external rib in a recess that is formed in the external surface of the golf club head. The external rib includes a first rib, a second rib, and a third rib. The first rib is elongated in the toe-heel direction of the golf club head. The second rib is elongated in the face-back direction of the golf club head. The third rib extends continuously from the first rib to the second rib.

8 Claims, 6 Drawing Sheets

(56) References Cited

U.S. PATENT DOCUMENTS 7,241,230 B2 * 7/2007 Tsunoda ..... A63B 53/04 473/324
7,771,291 B1 * 8/2010 Willett ..... A63B 53/0466 473/337
8,409,030 B2 4/2013 Hoffman et al.
8,657,703 B2 * 2/2014 Wada ..... A63B 53/0466 473/335
8,790,195 B1 * 7/2014 Myers ..... A63B 53/0466 473/338
8,968,116 B1 * 3/2015 Myers ..... A63B 53/0466 473/338
9,827,469 B1 * 11/2017 Seluga ..... A63B 53/0466
9,901,789 B2 * 2/2018 Kitagawa ..... A63B 53/0466
9,914,030 B2 * 3/2018 Cleghorn ..... A63B 53/0466
9,937,389 B2 * 4/2018 Kitagawa ..... A63B 53/0466
9,937,390 B2 * 4/2018 Luttrell ..... A63B 53/06
9,950,219 B2 * 4/2018 Larson ..... A63B 53/0466
10,076,691 B1 * 9/2018 Kingston ..... A63B 53/0466
2002/0098910 A1 * 7/2002 Gilbert ..... A63B 53/04 473/332
2006/0094527 A1 * 5/2006 Evans ..... A63B 53/0466 473/328
2007/0117648 A1 * 5/2007 Yokota ..... A63B 53/0466 473/328
2008/0119303 A1 * 5/2008 Bennett ..... A63B 53/02 473/338
2008/0318705 A1 * 12/2008 Clausen ..... A63B 53/04 473/291
2009/0258724 A1 * 10/2009 Rice ..... A63B 60/00 473/329
2010/0267463 A1 * 10/2010 Stites ..... A63B 53/047 473/291
2011/0053703 A1 * 3/2011 Stites ..... A63B 53/0466 473/291
2011/0124432 A1 * 5/2011 Oldknow ..... A63B 53/047 473/334
2011/0151996 A1 * 6/2011 Dewhurst ..... A63B 53/04 473/329
2011/0207551 A1 * 8/2011 Breier ..... A63B 53/047 473/332
2012/0021849 A1 * 1/2012 Gibbs ..... A63B 53/02 473/342
2012/0122601 A1 * 5/2012 Beach ..... A63B 53/0466 473/248
2012/0165115 A1 * 6/2012 Matsunaga ..... A63B 53/04 473/336
2012/0289360 A1 * 11/2012 Breier ..... A63B 53/047 473/335
2013/0109500 A1 * 5/2013 Boyd ..... A63B 53/047 473/332
2013/0165257 A1 * 6/2013 Dipert ..... A63B 53/047 473/349
2013/0225306 A1 * 8/2013 David ..... A63B 53/04 473/251
2013/0225319 A1 * 8/2013 Kato ..... A63B 53/047 473/331
2013/0288820 A1 * 10/2013 Shimahara ..... A63B 60/00 473/331
2013/0331201 A1 * 12/2013 Wahl ..... A63B 53/0475 473/329
2014/0024475 A1 * 1/2014 Motokawa ..... A63B 53/02 473/338
2014/0038747 A1 * 2/2014 Dolezel ..... A63B 53/04 473/342
2014/0080634 A1 * 3/2014 Golden ..... A63B 60/00 473/345
2015/0094166 A1 * 4/2015 Taylor ..... A63B 53/0466 473/335
2015/0231454 A1 * 8/2015 Parsons ..... A63B 53/0475 473/335
2015/0231806 A1 * 8/2015 Parsons ..... B29C 45/14467 264/261
2015/0343278 A1 * 12/2015 Franklin ..... A63B 53/02 473/309
2015/0367198 A1 * 12/2015 Seagram ..... A63B 53/047 473/349
2016/0059090 A1 * 3/2016 Parsons ..... A63B 53/0466 473/338
2016/0096082 A1 * 4/2016 Boggs ..... A63B 53/04 473/324
2016/0096085 A1 * 4/2016 Boggs ..... A63B 53/0466 473/350
2016/0151687 A1 6/2016 Larson et al.
2016/0184666 A1 * 6/2016 Mizutani ..... A63B 53/0466 473/342
2016/0193508 A1 * 7/2016 Issertell ..... A63B 53/047 473/342
2016/0250534 A1 * 9/2016 Solheim ..... A63B 60/50 473/346
2016/0310809 A1 * 10/2016 Boggs ..... A63B 60/02
2016/0317880 A1 * 11/2016 Boggs ..... A63B 53/0466
2016/0332042 A1 11/2016 Takechi
2016/0346644 A1 * 12/2016 Larson ..... A63B 53/0466
2016/0346647 A1 12/2016 Stokke et al.
2016/0375321 A1 * 12/2016 Greaney ..... A63B 53/0466 473/219
2017/0028270 A1 * 2/2017 Westrum ..... A63B 53/047
2017/0072277 A1 * 3/2017 Mata ..... A63B 53/06
2017/0100649 A1 * 4/2017 Seluga ..... A63B 53/0466
2017/0144034 A1 * 5/2017 Seluga ..... A63B 53/0466
2017/0173417 A1 * 6/2017 Seluga ..... A63B 53/0466
2017/0182381 A1 * 6/2017 Seluga ..... A63B 53/0475
2018/0001159 A1 * 1/2018 Mizutani ..... A63B 53/0466
2018/0001170 A1 * 1/2018 Mizutani ..... A63B 60/52
2018/0028879 A1 * 2/2018 Ines ..... A63B 53/047
2018/0028882 A1 * 2/2018 Hebreo ..... A63B 53/08
2018/0071591 A1 * 3/2018 Seluga ..... B22C 9/24
2018/0133566 A1 * 5/2018 Kitagawa ..... A63B 53/0466
2018/0140916 A1 * 5/2018 Sillies ..... A63B 60/02
2018/0264330 A1 * 9/2018 Kitagawa ..... A63B 53/0466
2019/0046846 A1 * 2/2019 Sargent ..... A63B 53/06
2019/0046848 A1 * 2/2019 Kato ..... A63B 53/0466
2019/0060718 A1 * 2/2019 Milleman ..... A63B 53/0466
2019/0060719 A1 * 2/2019 Greaney ..... A63B 71/0619
2019/0168087 A1 * 6/2019 Martens ..... A63B 53/0475
2019/0184246 A1 * 6/2019 Harbert ..... A63B 53/06

* cited by examiner

GOLF CLUB WITH WEIGHT AND EXTERNAL RIB IN RECESS ON SOLE

CROSS-REFERENCE TO RELATED APPLICATION

This application is based upon and claims priority to Japanese Patent Application No. 2017-215032, filed on Nov. 7, 2017, the entire contents of which are incorporated herein by reference.

BACKGROUND OF THE INVENTION

1. Field of the Invention

The present invention generally relates to golf club heads.

2. Description of the Related Art

Conventionally, it has been proposed to provide a rib on the internal surface or external surface of a golf club head. The ball striking performance of the golf club head changes depending on a position at which the rib is provided or the shape of the rib. (See, for example, Japanese Laid-Open Patent Publication Nos. 2016-214379 and 2016-106886, U.S. Pat. No. 8,409,030, and U.S. Patent Application Publication Nos. 2016/0346647, 2016/0151687, and 2016/0096085.)

SUMMARY OF THE INVENTION

According to an aspect of the present invention, a golf club head includes a face including a ball striking surface, a sole defining the bottom of the golf club head, and an external rib in a recess that is formed in the external surface of the golf club head. The external rib includes a first rib, a second rib, and a third rib. The first rib is elongated in the toe-heel direction of the golf club head. The second rib is elongated in the face-back direction of the golf club head. The third rib extends continuously from the first rib to the second rib.

The object and advantages of the invention will be realized and attained by means of the elements and combinations particularly pointed out in the claims.

It is to be understood that both the foregoing general description and the following detailed description are exemplary and explanatory and not restrictive of the invention.

DETAILED DESCRIPTION OF THE PREFERRED EMBODIMENTS

Figure 1A:
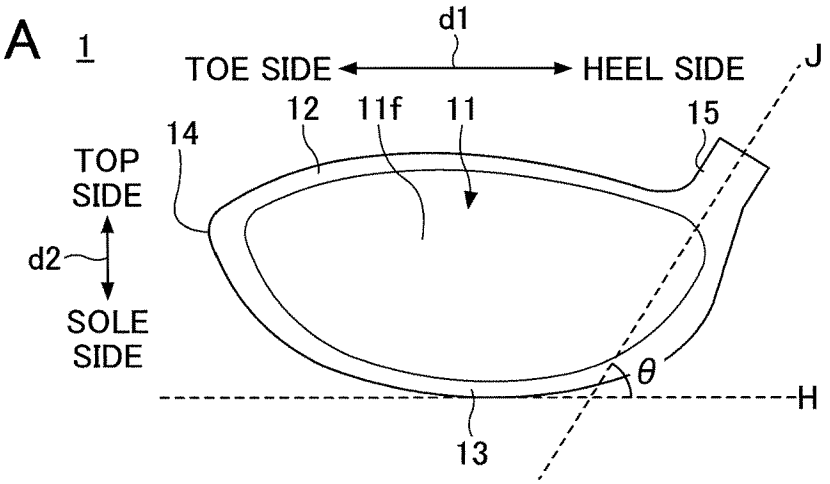
FIGS. 1A through 1D are diagrams illustrating a golf club head according to an embodiment.

One or more embodiments are described below with reference to the accompanying drawings. In the following description, the same elements are referred to using the same reference numeral, and duplicate description thereof may be omitted.

FIGS. 1A, 1B, 10 and 1D are a front elevational view, a bottom (sole side) view, a left side (toe side) elevational view, and a right side (heel side) elevational view, respectively, of a golf club head 1 according to an embodiment.

Figure 1B:
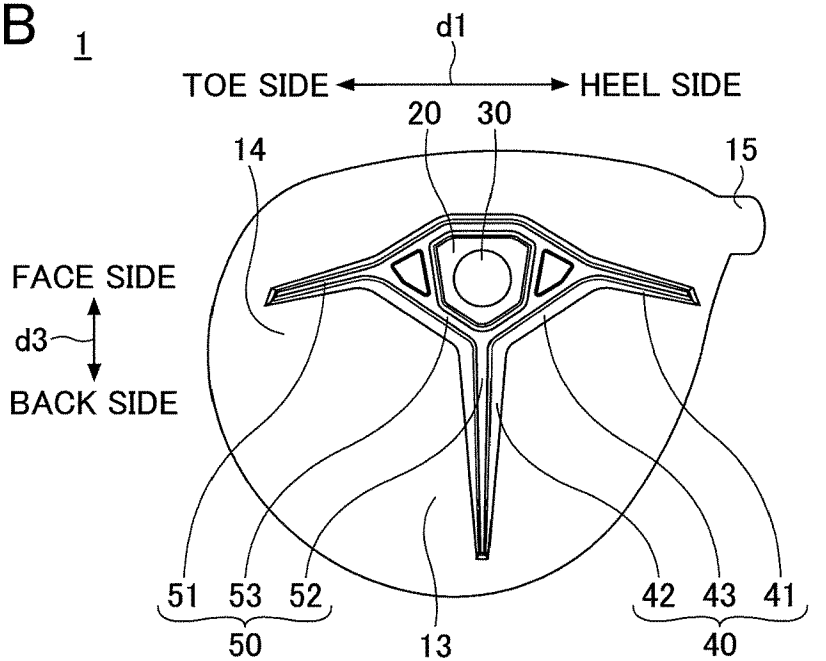
Figure 1C:
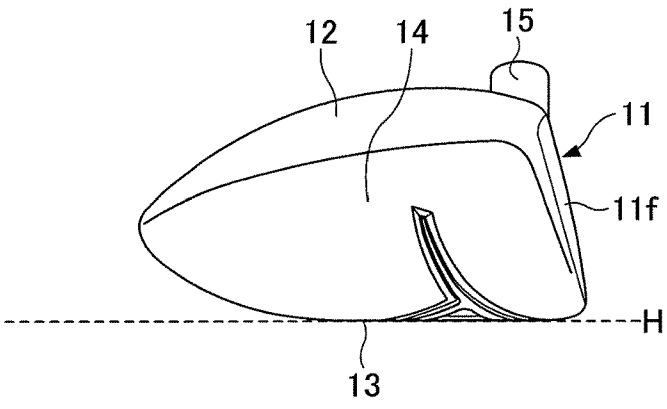
Figure 1D:
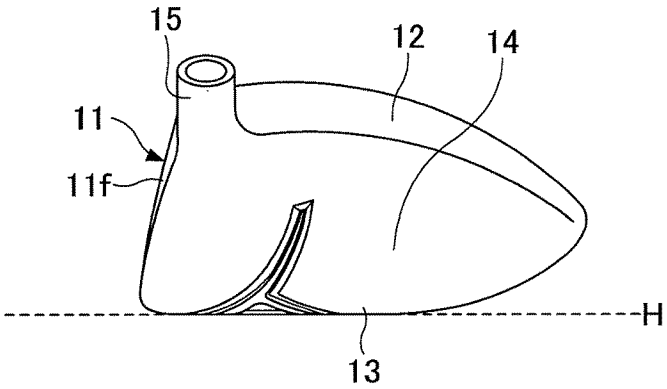

The front elevational view of FIG. 1A is a view taken from the side of a face surface 11*f* of the golf club head 1 (that is, looking at the face surface 11*f*), depicting the golf club head 1 resting (soled) on a horizontal plane H (corresponding to a ground surface) at a reference lie angle θ and a reference loft angle (not depicted). In FIG. 1A, the central axis of the bore of a hosel 15 is indicated by the dashed line J. In FIGS. 1A and 1B, the double-headed arrow d1 indicates the "toe-heel" (left-right) direction, namely, the direction from the toe side to the heel side or the direction from the heel side to the toe side, of the golf club head 1, the double-headed arrow d2 indicates the "top-sole" (up-down) direction, namely, the direction from the top side to the sole side or the direction from the sole side to the top side, of the golf club head 1, and the double-headed arrow d3 indicates the "face-back" (front-rear) direction, namely, the direction from the face side to the back side or the direction from the back side to the face side, of the golf club head 1.

The golf club head 1 depicted in FIGS. 1A through 1D is a wood-type golf club head such as a driver club head, but may also be a hybrid club head or a fairway wood club head. The golf club head 1 may be made using a metal material such as a titanium alloy, titanium, stainless steel, or an aluminum alloy. Multiple parts may be joined and assembled into the golf club head 1. The golf club head 1 is described in more detail below.

The golf club head 1 is a hollow structure that includes a face 11, a crown 12, a sole 13, a sidewall 14, and the hosel 15. An internal surface of the hollow structure may be referred to as "head internal surface" and an external surface of the hollow structure may be referred to as "head external surface."

The face 11 defines a front portion of the golf club head 1, and includes the face surface 11*f*, which defines a ball-striking surface between the crown 12 and the sole 13 in the top-sole direction. The face 11 has a predetermined thickness. The face surface 11*f* forms an external surface of the face 11. The crown 12 defines a top portion of the golf club head 1. The sole 13 defines a bottom portion of the golf club head 1. The sidewall 14 extends between the crown 12 and the sole 13 to define a curved periphery of the golf club head 1 that is continuous with the face surface 11*f*. The hosel 15 receives a shaft.

An attachment part 20 (weight port) configured to receive an attachment member 30 (weight) for head weight adjustment is provided in the sole 13. A recess 40 is provided in the sole-side head external surface, and an external rib 50 is provided in the recess 40. By providing the external rib 50 on the sole side, it is possible to increase the stiffness of the sole 13 and to improve the ball striking performance of the golf club head 1.

Figure 2:
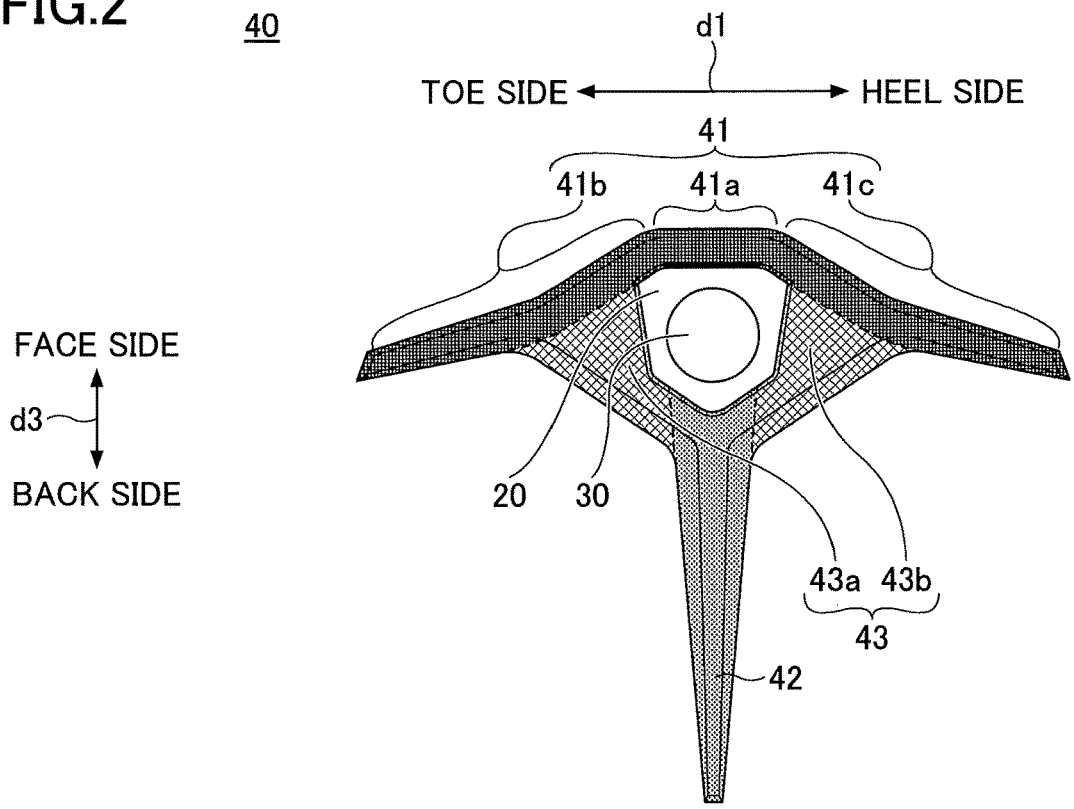
FIG. 2 is a diagram illustrating a recess.

FIG. 2 is a diagram illustrating the recess 40. The attachment part 20, the attachment member 30, and the recess 40 are taken out from FIG. 1B and depicted in FIG. 2.

Referring to FIG. 2, the recess 40 includes a first recess 41 elongated in the toe-heel direction, the second recess 42 elongated in the face-back direction, and a third recess 43 connecting (extending between) the first recess 41 and the second recess 42. In other words, the first recess 41 and the second recess 42 are continuous through the third recess 43.

In FIG. 2, the first recess 41, the second recess 42, and the third recess 43 are conveniently indicated by different dot patterns to clarify their respective regions. The first recess 41, the second recess 42, and the third recess 43 are described in detail below.

The first recess 41 includes a portion 41*a*, a portion 41*b*, and a portion 41*c*. The portion 41*a* is placed along the attachment part 20 on its face side. The portion 41*b* extends from the portion 41*a* toward the toe. The portion 41*c* extends from the portion 41*a* toward the heel. The portions 41*b* and 41*c* extend substantially symmetrically in the toe-heel direction relative to the attachment part 20.

The second recess 42 extends from the vicinity of the back-side end of the attachment part 20 toward the back. The second recess 42 decreases in width from the vicinity of the back-side end of the attachment part 20 toward the back.

The third recess 43 includes a portion 43*a* and a portion 43*b* that are positioned on the toe side and the heel side, respectively, of the attachment part 20. The portion 43*a* connects (extends between) the portion 41*b* of the first recess 41 and the second recess 42. The portion 43*b* connects (extends between) the portion 41*c* of the first recess 41 and the second recess 42.

Figure 3:
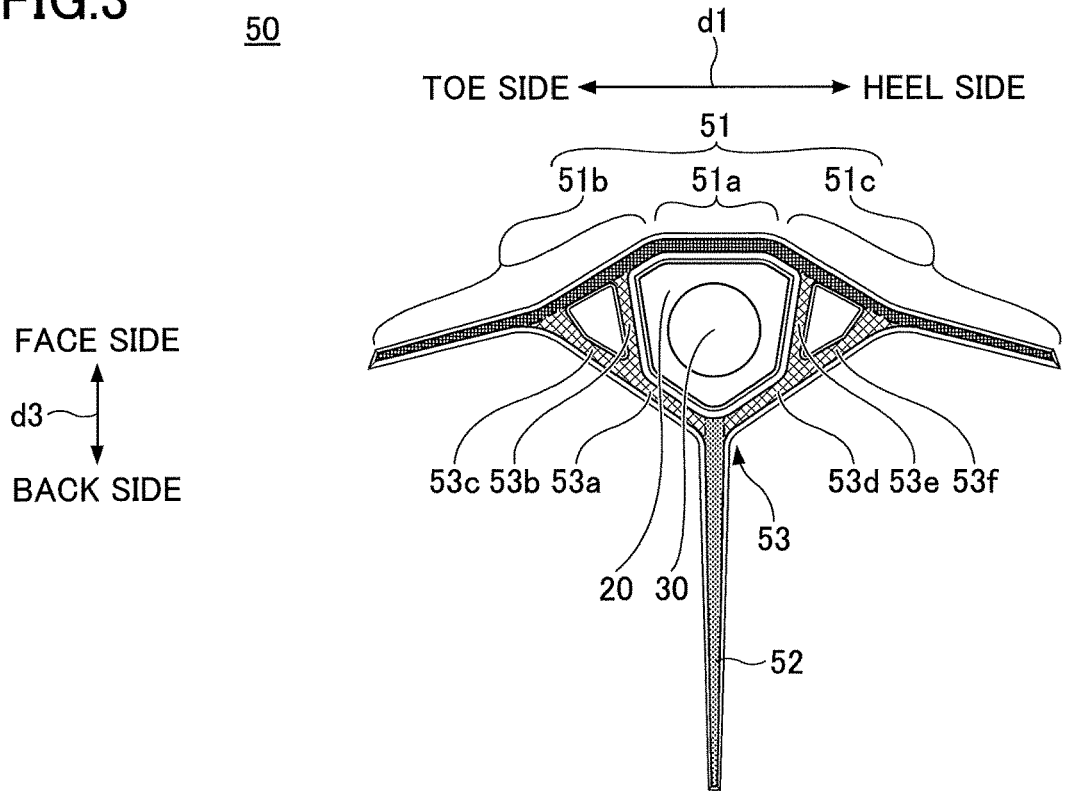
FIG. 3 is a diagram illustrating an external rib.

FIG. 3 is a diagram illustrating the external rib 50. The attachment part 20, the attachment member 30, and the external rib 50 are taken out from FIG. 1B and depicted in FIG. 3.

Referring to FIG. 3, the external rib 50 includes a first rib 51, a second rib 52, and a third rib 53. The first rib 51 is elongated in the toe-heel direction. The second rib 52 is elongated in the face-back direction. The third rib 53 connects (extends between) the first rib 51 and the second rib 52. In other words, the first rib 51 and the second rib 52 are continuous through the third rib 53. The first rib 51 includes a portion that extends from the third rib 53 side in a direction away from the attachment part 20. The second rib 52 includes a portion that extends from the third rib 53 side in a direction away from the attachment part 20.

In FIG. 3, the upper surfaces of the first rib 51, the second rib 52, and the third rib 53 are conveniently indicated by different dot patterns to clarify the regions of the first rib 51, the second rib 52, and the third rib 53. The same is the case with FIG. 4A. The first rib 51, the second rib 52, and the third rib 53 are described in detail below.

The first rib 51 includes a portion 51*a*, a portion 51*b*, and a portion 51*c*. The portion 51*a* is placed along the attachment part 20 on its face side. The portion 51*b* extends from the portion 51*a* toward the toe. The portion 51*c* extends from the portion 51*a* toward the heel. The portions 51*b* and 51*c* extend substantially symmetrically in the toe-heel direction relative to the attachment part 20. The portions 51*a*, 51*b* and 51*c* are spaced apart from the attachment part 20, and are out of contact with the attachment part 20.

The second rib 52 extends from the vicinity of the back-side end of the attachment part 20 toward the back. The second rib 52 decreases in width from the vicinity of the back-side end of the attachment part 20 toward the back. There is a space between the second rib 52 and the attachment part 20 on the face 10 side of the second rib 52, so that the second rib 52 is out of contact with the attachment part 20.

The third rib 53 includes portions 53*a*, 53*b*, 53*c*, 53*d*, 53*e*, and 53*f*.

The portion 53*a* is placed along part of the attachment part 20 on its back side. The portion 53*a* has one end connected to the second rib 52 on its attachment part 20 side and the other end connected to the connection of the portions 53*b* and 53*c*. The portion 53*b* branches from the portion 53*a* to be placed along the attachment part 20 on its toe side, and connects to the portion 51*b* of the first rib 51 at one point. The portion 53*c* branches from the portion 53*a* to be spaced apart from the portion 53*b*, and connects to the portion 51*b* of the first rib 51 at another point. The portions 53*a* and 53*b* are spaced apart from the attachment part 20, and are out of contact with the attachment part 20.

The portion 53*d* is placed along part of the attachment part 20 on its back side. The portion 53*d* has one end connected to the second rib 52 on its attachment part 20 side and the other end connected to the connection of the portions 53*e* and 53*f*. The portion 53*e* branches from the portion 53*d* to be placed along the attachment part 20 on its heel side, and connects to the portion 51*c* of the first rib 51 at one point. The portion 53*f* branches from the portion 53*d* to be spaced apart from the portion 53*e*, and connects to the portion 51*c* of the first rib 51 at another point. The portions 53*d* and 53*e* are spaced apart from the attachment part 20, and are out of contact with the attachment part 20.

Figure 4A:
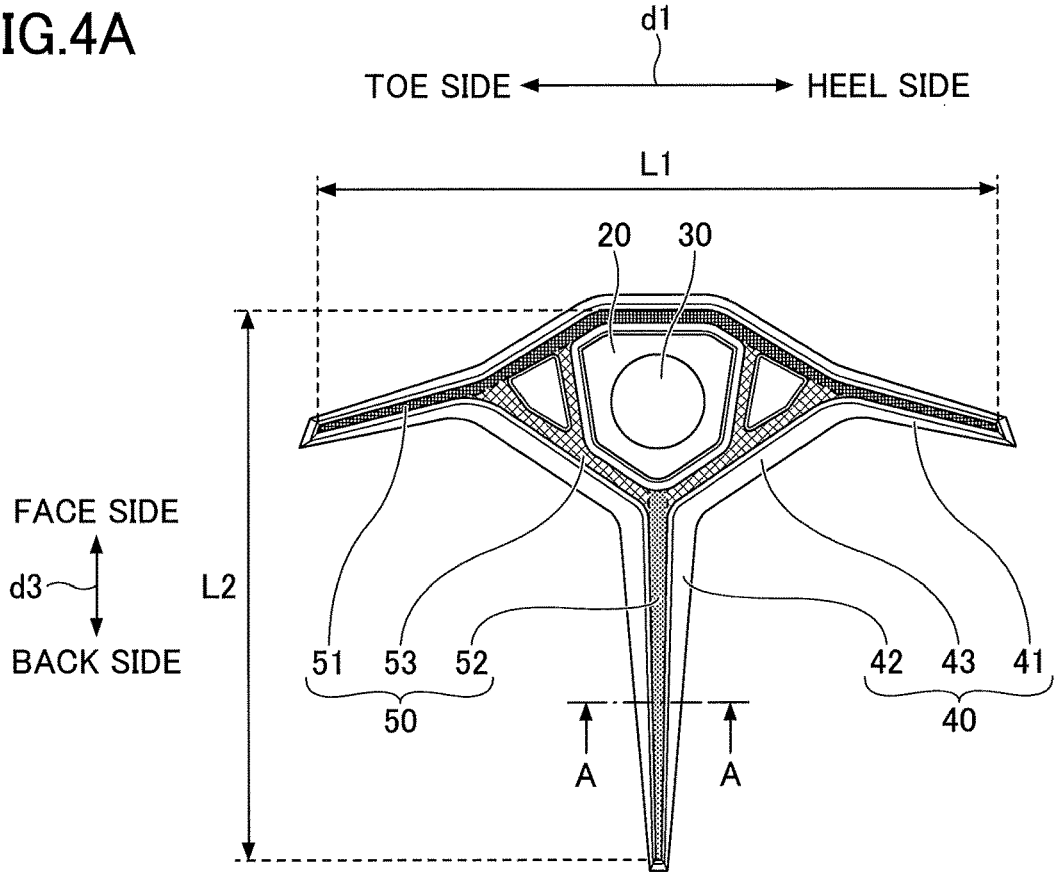
FIGS. 4A and 4B are diagrams illustrating the recess and the external rib.
Figure 4B:
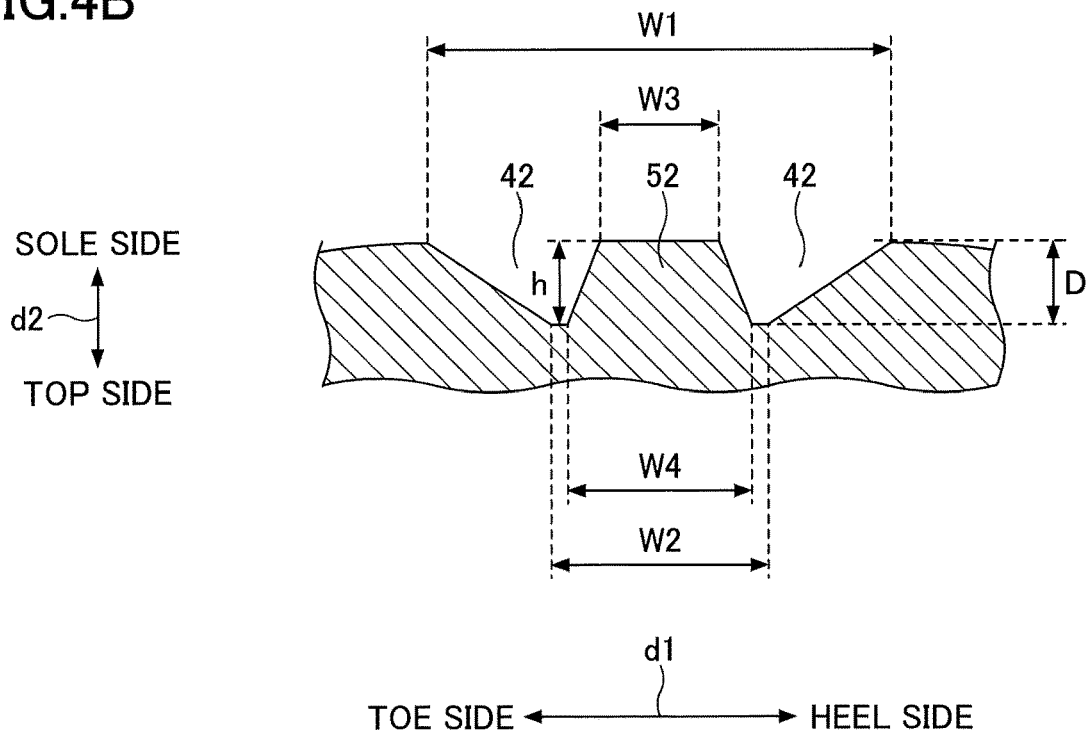

FIGS. 4A and 4B are diagrams illustrating the recess 40 and the external rib 50. The attachment part 20, the attachment member 30, the recess 40, and the external rib 50 are taken out from FIG. 1B and depicted in FIG. 4A. FIG. 4B is an enlarged cross-sectional view, taken along the line A-A in FIG. 4A.

Referring to FIGS. 1A through 4B, according to the golf club head 1, the recess 40 is provided in the sole-side head external surface, and the external rib 50 is placed in the recess 40. To be more specific, the first rib 51 is placed in the first recess 41, the second rib 52 is placed in the second recess 42, and the third rib 53 is placed in the third recess 43.

To be yet more specific, the portion 51*a* is placed in the portion 41*a*, the portion 51*b* is placed in the portion 41*b*, and the portion 51*c* is placed in the portion 41*c*. Furthermore, the portions 53*a*, 53*b* and 53*c* are placed in the portion 43*a*, and the portions 53*d*, 53*e* and 53*f* are placed in the portion 43*b*.

A length L1 of the external rib 50 in the toe-heel direction is, for example, 60 mm or more and 120 mm or less. A length L2 of the external rib 50 in the face-back direction is, for example, 40 mm or more and 110 mm or less.

Referring to FIG. 4B, the cross-sectional shape of the second recess 42 in a transverse direction, namely, the shape of a cross section of the second recess 42 taken along a plane perpendicular to a longitudinal direction of the second recess 42, is, for example, a substantially trapezoidal shape that decreases in width from the head external surface side to the head internal surface side. A width W1 of the second recess 42 on the head external surface side (at the top of the second recess 42) is, for example, 1 mm or more and 30 mm or less. A width W2 of the second recess 42 on the head internal surface side (at the bottom of the second recess 42) is, for example, 0.5 mm or more and 30 mm or less. A depth D of the second recess 42 from the head external surface is, for example, 1 mm or more and 10 mm or less.

The second rib 52 protrudes outward from the bottom surface of the second recess 42 to the head external surface side. The cross-sectional shape of the second rib 52 in a transverse direction, namely, the shape of a cross section of the second rib 52 taken along a plane perpendicular to a longitudinal direction of the second rib 52, is, for example, a substantially trapezoidal shape that decreases in width from the head internal surface side to the head external surface side. A width W3 of the second rib 52 on the head external surface side (at the top of the second rib 52) is, for example, 0.5 mm or more and 20 mm or less. A width W4 of the second rib 52 on the head internal surface side (at the bottom of the second rib 52) is, for example, 0.5 mm or more and 30 mm or less. A height h (the amount of protrusion) of the second rib 52 from the bottom surface of the second recess 42 is, for example, 1 mm or more and 10 mm or less. The width W4 of the second rib 52 may be equal to the width W2 of the second recess 42.

The height h of the second rib 52 is less than or equal to the depth D of the second recess 42. That is, the second rib 52 is designed so that the top end portion of the second rib 52 does not protrude out of the second recess 42, that is, the top end portion of the second rib 52 does not protrude from the head external surface. This makes it possible to stably sole the golf club head 1.

While the cross-sectional shapes of the second recess 42 and the second rib 52 are described above, the same is the case with the cross-sectional shapes of the first recess 41 and the first rib 51 and the cross-sectional shapes of the third recess 43 and the third rib 53.

Figure 5A:
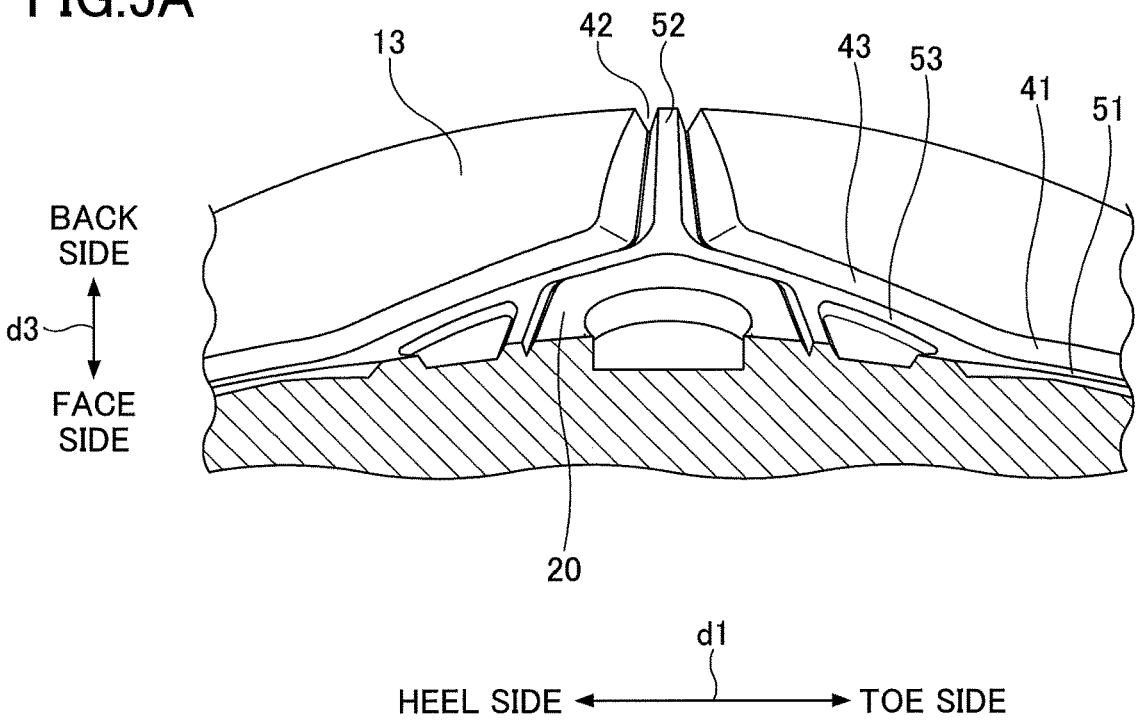
FIGS. 5A and 5B are sectional views illustrating an attachment part and an attachment member.
Figure 5B:
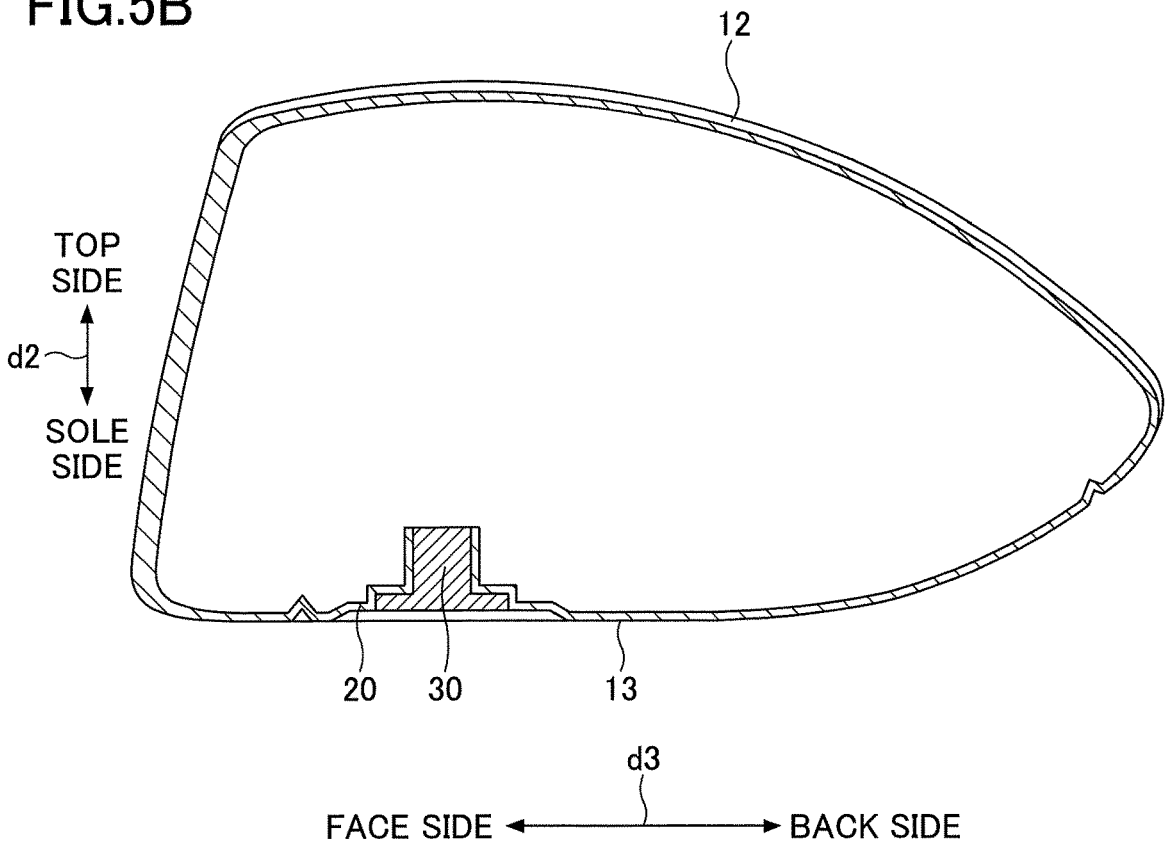

FIGS. 5A and 5B are sectional views, illustrating the attachment part 20 and the attachment member 30. FIG. 5A shows a cross section in the toe-heel direction, passing through the attachment part 20 from which the attachment member 30 is detached. FIG. 5B shows a cross section in the face-back direction, passing through the attachment part 20 and the attachment member 30 attached to the attachment part 20.

The attachment member 30 depicted in FIGS. 1B and 5B is detachable from and reattachable to the attachment part 20. The attachment member 30 of a necessary weight may be attached to the attachment part 20 as required. The position of the center of gravity of the golf club head 1 can be adjusted by weight adjustment using the attachment member 30.

When the attachment member 30 is attached to the attachment part 20, the sole 13 is heaviest in a part near the attachment member 30. Therefore, the sole 13 vibrates most significantly in the part near the attachment member 30, which becomes the position of the antinode of the first-order vibration mode. The position of the antinode of the first-order vibration mode in the sole 13 may be determined by modal analysis using a computer or eigenvalue analysis using the finite element method (FEM).

This vibration is not preferable for an impact sound. Therefore, it is effective to reduce vibrations near the attachment member 30 to improve an impact sound.

Therefore, according to the golf club head 1, the external rib 50 is provided so that the third rib 53 of the external rib 50 at least partially surrounds the attachment part 20. This makes it possible to effectively reduce vibrations near the attachment member 30, and accordingly, to improve an impact sound.

The first rib 51 and the second rib 52 of the external rib 50 preferably include a portion that extends beyond a vibration region of the first-order vibration mode of the sole 13. Because the external rib 50 includes the first rib 51, which includes a portion extending in the toe-heel direction beyond the vibration region of the first-order vibration, and the second rib 52, which includes a portion extending in the face-back direction beyond the vibration region of the first-order vibration, it is possible to more effectively reduce vibrations of the golf club head 1 generated at the time of striking a ball, and accordingly, to improve an impact sound.

In the specification, "at least partially surrounding the attachment part" includes a configuration where a rib wholly (completely) surrounds the attachment part and a configuration where a rib partially surrounds the attachment part (that is, a rib extends along part of the periphery of the attachment part). Furthermore, "partially surrounding the attachment part" refers to a configuration where the center of the attachment part is within a closed area formed by connecting adjacent ends of one or more ribs placed along the periphery of the attachment part by one or more virtual straight lines.

VARIATIONS

Next, variations of the above-described embodiment are described. The variations illustrate external ribs having different shapes. In the following description of the variations, a description of the same elements or components as those of the above-described embodiment may be omitted.

First Variation

Figure 6:
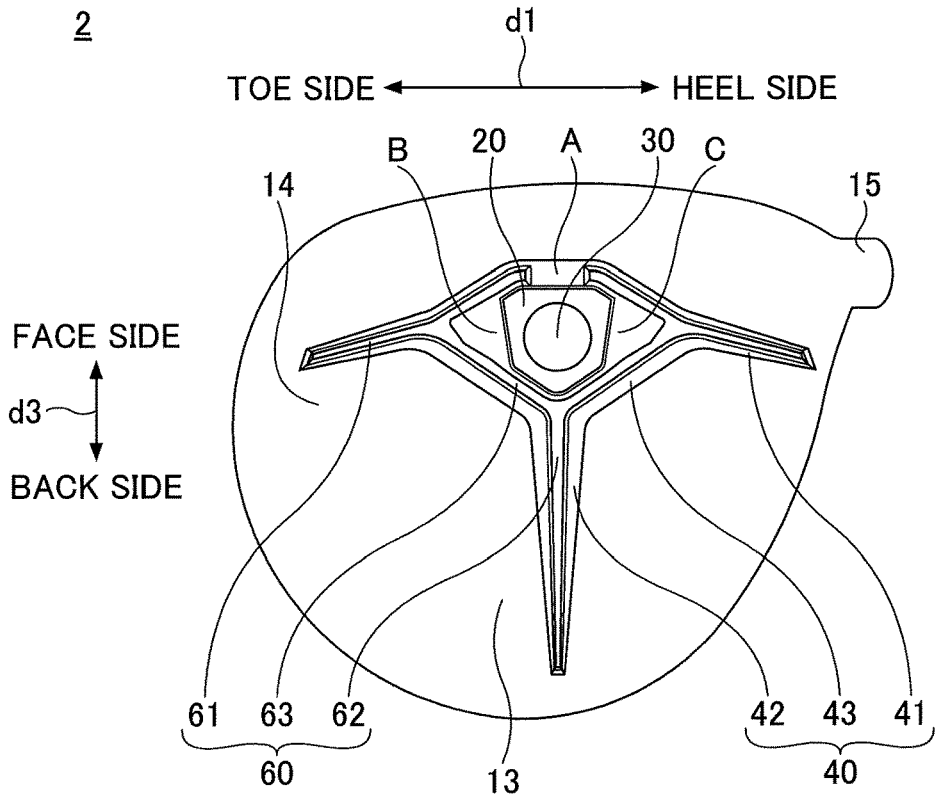
FIG. 6 is a bottom plan view of a golf club head according to a first variation of the embodiment.

FIG. 6 is a bottom plan view of a golf club head 2 according to a first variation of the embodiment. Referring to FIG. 6, the golf club head 2 is different from the golf club head 1 (see, for example, FIG. 1B) in that the first rib 51, the second rib 52, and the third rib 53 of the external rib 50 are replaced with a first rib 61, a second rib 62, and a third rib 63, respectively, of an external rib 60.

The first rib 61 extends in the toe-heel direction the same as the first rib 51. Unlike the first rib 51, however, the first rib 61 is not provided in Area A. Otherwise, the first rib 61 is the same as the first rib 51. Area A corresponds to the portion 51*a* in FIG. 3.

Although referred to using a different reference numeral, the second rib 62 is exactly the same as the second rib 52.

The third rib 63 at least partially surrounds the attachment part 20 the same as the third rib 53. Unlike the third rib 53, however, the third rib 63 is provided in neither Area B nor Area C. Otherwise, the third rib 63 is the same as the third rib 53. Area B corresponds to the portion 53*b* in FIG. 3. Area C corresponds to the portion 53*e* in FIG. 3.

Although the third rib 63 is provided in neither Area B nor Area C, the golf club head 2 is equal to the golf club head 1 in that the third rib 63 at least partially surrounds the attachment part 20. The same as in the golf club head 1, it is possible to effectively reduce vibrations near the attachment member 30, and accordingly, to improve an impact sound.

Furthermore, although the first rib 61 is not provided in Area A, the golf club head 2 is equal to the golf club head 1 in that the first rib 61 extends in the toe-heel direction beyond the vibration region of the first-order vibration. Furthermore, the same as in the golf club head 1, the second rib 62 that extends in the face-back direction beyond the vibration region of the first-order vibration is provided in the golf club head 2. Therefore, the same as in the golf club head 1, it is possible to more effectively reduce vibrations of the golf club head 2 generated at the time of striking a ball, and accordingly, to improve an impact sound.

Second Variation

Figure 7:
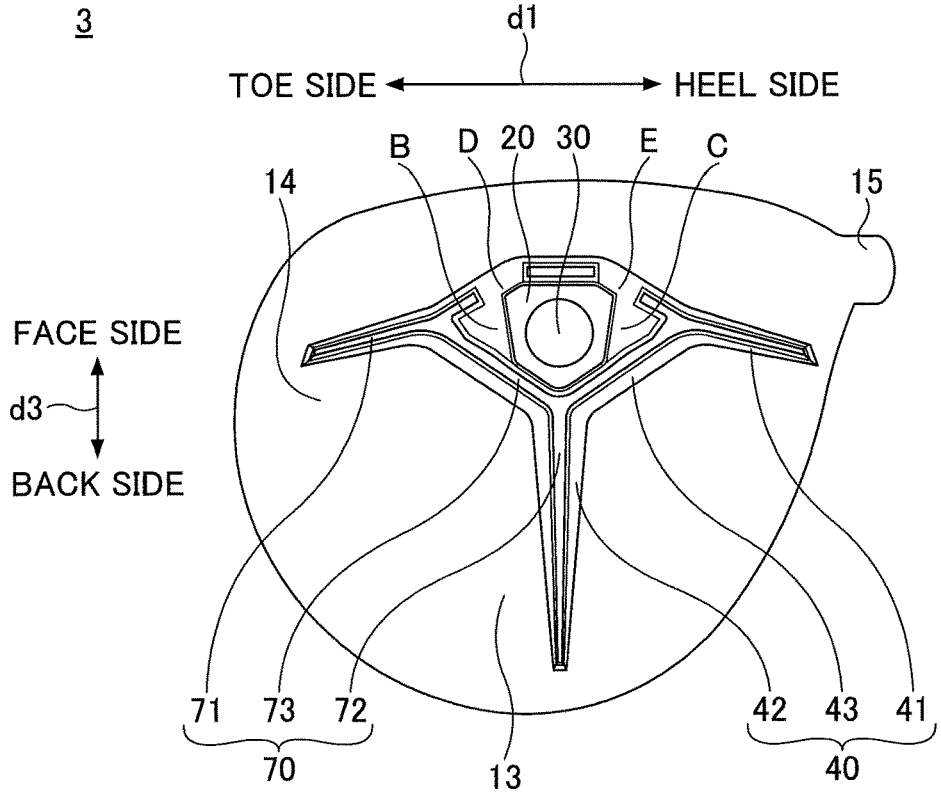
FIG. 7 is a bottom plan view of a golf club head according to a second variation of the embodiment.

FIG. 7 is a bottom plan view of a golf club head 3 according to a second variation of the embodiment. Referring to FIG. 7, the golf club head 3 is different from the golf club head 1 (see, for example, FIG. 1B) in that the first rib 51, the second rib 52, and the third rib 53 of the external rib 50 are replaced with a first rib 71, a second rib 72, and a third rib 73, respectively, of an external rib 70.

The first rib 71 extends in the toe-heel direction the same as the first rib 51. Unlike the first rib 51, however, the first rib 71 is provided in neither Area D nor Area E. Otherwise, the first rib 71 is the same as the first rib 51. Area D corresponds to a toe-side part of the portion 51*a* that is on the heel side of the connection of the portions 51*b* and 53*c* in FIG. 3. Area E corresponds to a heel-side part of the portion 51*a* that is on the toe side of the connection of the portions 51*c* and 53*f* in FIG. 3.

Although referred to using a different reference numeral, the second rib 72 is exactly the same as the second rib 52.

The third rib 73 at least partially surrounds the attachment part 20 the same as the third rib 53. Unlike the third rib 53, however, the third rib 73 is provided in neither Area B nor Area C. Otherwise, the third rib 73 is the same as the third rib 53. Area B corresponds to the portion 53*b* in FIG. 3. Area C corresponds to the portion 53*e* in FIG. 3.

Although the third rib 73 is provided in neither Area B nor Area C, the golf club head 3 is equal to the golf club head 1 in that the third rib 73 at least partially surrounds the attachment part 20. The same as in the golf club head 1, it is possible to effectively reduce vibrations near the attachment member 30, and accordingly, to improve an impact sound.

Furthermore, although the first rib 71 is provided in neither Area D nor Area E, the golf club head 3 is equal to the golf club head 1 in that the first rib 71 extends in the toe-heel direction beyond the vibration region of the first-order vibration. Furthermore, the same as in the golf club head 1, the second rib 72 that extends in the face-back direction beyond the vibration region of the first-order vibration is provided in the golf club head 3. Therefore, the same as in the golf club head 1, it is possible to more effectively reduce vibrations of the golf club head 3 generated at the time of striking a ball, and accordingly, to improve an impact sound.

Third Variation

Figure 8:
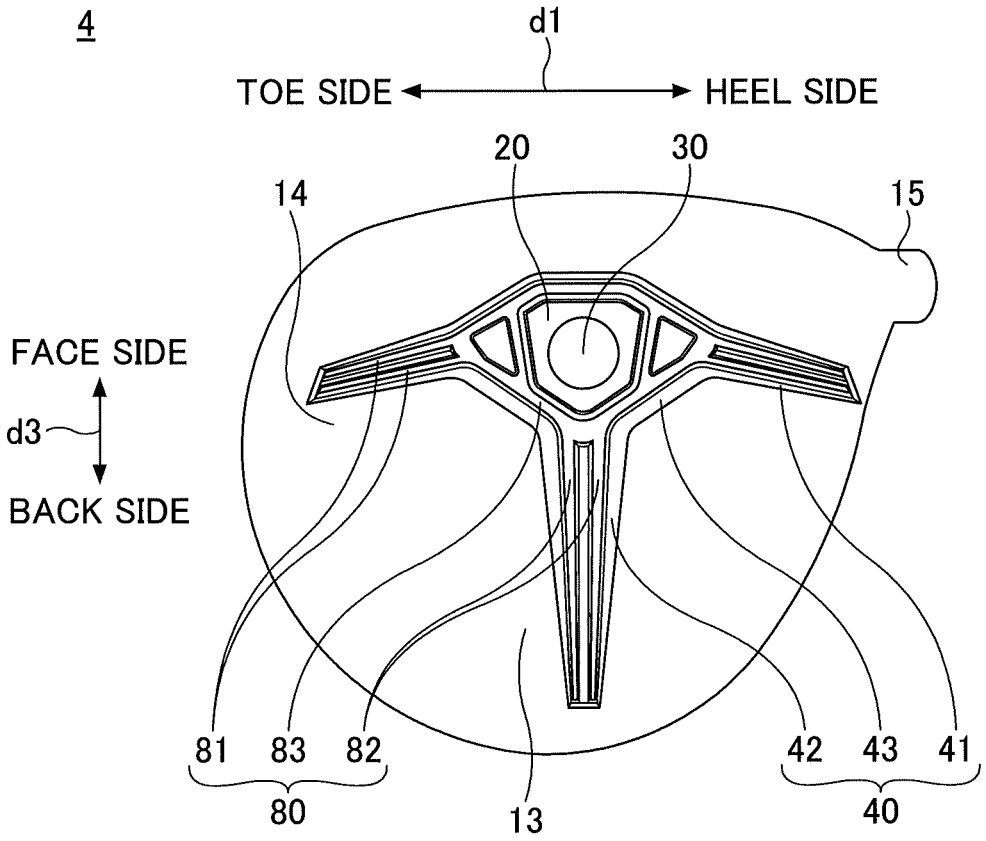
FIG. 8 is a bottom plan view of a golf club head according to a third variation of the embodiment.

FIG. 8 is a bottom plan view of a golf club head 4 according to a third variation of the embodiment. Referring to FIG. 8, the golf club head 4 is different from the golf club head 1 (see, for example, FIG. 1B) in that the first rib 51, the second rib 52, and the third rib 53 of the external rib 50 are replaced with a first rib 81, a second rib 82, and a third rib 83, respectively, of an external rib 80.

The first rib 81 extends in the toe-heel direction the same as the first rib 51. Unlike the first rib 51, however, the first rib 81 includes two ribs that are spaced apart and arranged side by side on each of the toe side and the heel side of the third rib 83. Otherwise, the first rib 81 is the same as the first rib 51.

The second rib 82 extends in the face-back direction the same as the second rib 52. Unlike the second rib 52, however, the second rib 82 includes two ribs that are spaced apart and arranged side by side on the back side of the third rib 83. Otherwise, the second rib 82 is the same as the second rib 52.

Although referred to using a different reference numeral, the third rib 83 is exactly the same as the third rib 53.

The golf club head 4 is equal to the golf club head 1 in that the third rib 83 at least partially surrounds the attachment part 20. The same as in the golf club head 1, it is possible to effectively reduce vibrations near the attachment member 30, and accordingly, to improve an impact sound.

Furthermore, according to the golf club head 4, the first rib 81 that extends in the toe-heel direction beyond the vibration region of the first-order vibration mode includes two ribs that are spaced apart and arranged side by side in part of the first rib 81. Furthermore, the second rib 82 that extends in the face-back direction beyond the vibration region of the first-order vibration mode includes two ribs that are spaced apart and arranged side by side in part of the second rib 82. Therefore, compared with the golf club head 1, it is possible to further increase the stiffness of the sole 13 and to further improve the ball striking performance. Furthermore, it is possible to more effectively reduce vibrations of the golf club head 4 generated at the time of striking a ball, and accordingly, to improve an impact sound.

The number of ribs that are arranged side by side in the first rib 81 may be three or more. Likewise, the number of ribs that are arranged side by side in the second rib 82 may be three or more. Furthermore, the third rib 83 may be partly or entirely composed of two or more ribs that are arranged side by side.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

For example, according to the above-described embodiment and variations, the second ribs 52, 62, 72 and 82 may be inclined toward the toe or the heel relative to the face-back direction. Furthermore, the first ribs 51, 61, 71 and 81 may be inclined toward the face 13 or the back relative to the toe-heel direction.

Furthermore, according to the above-described embodiment and variations, one or more additional ribs may be provided in addition to the first ribs 51, 61, 71 and 81, the second ribs 52, 62, 72 and 82, and the third ribs 53, 63, 73 and 83. Examples of additional ribs include a rib extending to the back side and the toe side from the third ribs 53, 63, 73 and 83, a rib extending to the back side and the heel side from the third ribs 53, 63, 73 and 83, a rib extending to the face 13 side and the toe side from the third ribs 53, 63, 73 and 83, a rib extending to the face 13 side and the heel side from the third ribs 53, and any combination of two or more of those ribs.

According to an aspect of the present invention, it is possible to provide a golf club head improved in ball striking performance.

What is claimed is:

1. A golf club head comprising:

a crown defining a top of the golf club head;

a sole defining a bottom of the golf club head;

a face including a ball striking surface, the face extending between the crown and the sole;

an attachment part provided in the sole;

an attachment member detachably attached to the attachment part; and an external rib in a recess, the recess being formed in a sole-side external surface of the golf club head, the external rib being exposed to an outside of the golf club head, the external rib including a first rib elongated in a toe-heel direction of the golf club head;

a second rib provided on a back side of the attachment part and elongated in a face-back direction of the golf club head, the second rib protruding from the sole-side external surface in a direction away from the crown in the recess; and a third rib extending continuously from the first rib to the second rib, the third rib at least partially surrounding the attachment part, wherein the second rib extends from the third rib toward a back of the golf club head.

2. The golf club head as claimed in claim 1, wherein the third rib is spaced apart from the attachment part.

3. The golf club head as claimed in claim 1, wherein the recess includes a first recess elongated in the toe-heel direction;

a second recess elongated in the face-back direction; and a third recess extending continuously from the first recess to the second recess.

4. The golf club head as claimed in claim 3, wherein the golf club head has a hollow structure, and a cross section of each of the first recess, the second recess, and the third recess taken along a plane perpendicular to a longitudinal direction thereof has a substantially trapezoidal shape that decreases in width from a side of the external surface of the golf club head to a side of an internal surface of the golf club head, the external surface being an external surface of the hollow structure, the internal surface being an internal surface of the hollow structure.

5. The golf club head as claimed in claim 3, wherein the first rib is in the first recess, the second rib is in the second recess, and the third rib is in the third recess.

6. The golf club head as claimed in claim 1, wherein the golf club head has a hollow structure, and a cross section of each of the first rib, the second rib, and the third rib taken along a plane perpendicular to a longitudinal direction thereof has a substantially trapezoidal shape that decreases in width from a side of an internal surface of the golf club head to a side of the external surface of the golf club head, the external surface being an external surface of the hollow structure, the internal surface being an internal surface of the hollow structure.

7. The golf club head as claimed in claim 1, wherein a length of the external rib in the toe-heel direction is 60 mm or more and 120 mm or less, and a length of the external rib in the face-back direction is 40 mm or more and 110 mm or less.

8. The golf club head as claimed in claim 1, wherein each of the first rib and the third rib protrudes from the sole-side external surface in the direction away from the crown in the recess.

* * * * *